United States Patent [19]

Benoit et al.

[11] Patent Number: 4,677,768

[45] Date of Patent: Jul. 7, 1987

[54] REAR ENTRY SKI BOOT

[75] Inventors: Louis Benoit, Frangy; Michel Mabboux, Seynod; Bernard Nerrinck, La Balme De Sillingy; Jean-Louis De Marchi, Duingt, all of France

[73] Assignee: Salomon S.A., Annecy, France

[21] Appl. No.: 827,007

[22] Filed: Feb. 7, 1986

Related U.S. Application Data

[63] Continuation-in-part of Ser. No. 700,302, Feb. 11, 1983.

[30] Foreign Application Priority Data

Feb. 10, 1984 [FR] France ..... 84 02900
May 18, 1984 [FR] France ..... 84 08598
Feb. 8, 1985 [FR] France ..... 85 01844

[51] Int. Cl.[4] ..... A43B 5/04

[52] U.S. Cl. ..... 36/117; 36/50; 36/119; 24/68 SK

[58] Field of Search ..... 36/117-121, 36/50; 24/68 SK

[56] References Cited

U.S. PATENT DOCUMENTS 4,160,332 7/1979 Salomon ..... 36/119
4,253,217 3/1981 Marzocchi ..... 36/50 X
4,539,763 9/1985 Walkhoff ..... 36/120
4,557,061 12/1985 Graillat et al. ..... 36/119
4,571,855 2/1986 Blanc ..... 36/50
4,593,483 6/1986 Benoit et al. .
4,596,080 6/1986 Paris .

FOREIGN PATENT DOCUMENTS 0053340 6/1982 European Pat. Off. .
0114209 8/1984 European Pat. Off. .
0120268 10/1984 European Pat. Off. ..... 36/117
3247516 6/1984 Fed. Rep. of Germany ..... 36/117
3502522 8/1985 Fed. Rep. of Germany .
3514657 11/1985 Fed. Rep. of Germany .
3524792 1/1986 Fed. Rep. of Germany .
2556187 6/1985 France ..... 36/117

*Primary Examiner*—James Kee Chi
*Attorney, Agent, or Firm*—Sandler & Greenblum

[57] ABSTRACT

A rear entry ski boot including two flexible tightening elements, one of which tightens the upper of the boot on the lower leg of the skier and the other of which presses the foot downwardly and rearwardly into the boot so as to hold down the foot in the zone of the short perimeter of the heel of the foot. Also provided are two separate and independent manipulation levers, one of which is positioned above the other on the posterior portion of upper. Each lever is journalled around at least one transverse axis and each lever is connected to a different one of the two flexible tightening elements.

32 Claims, 6 Drawing Figures

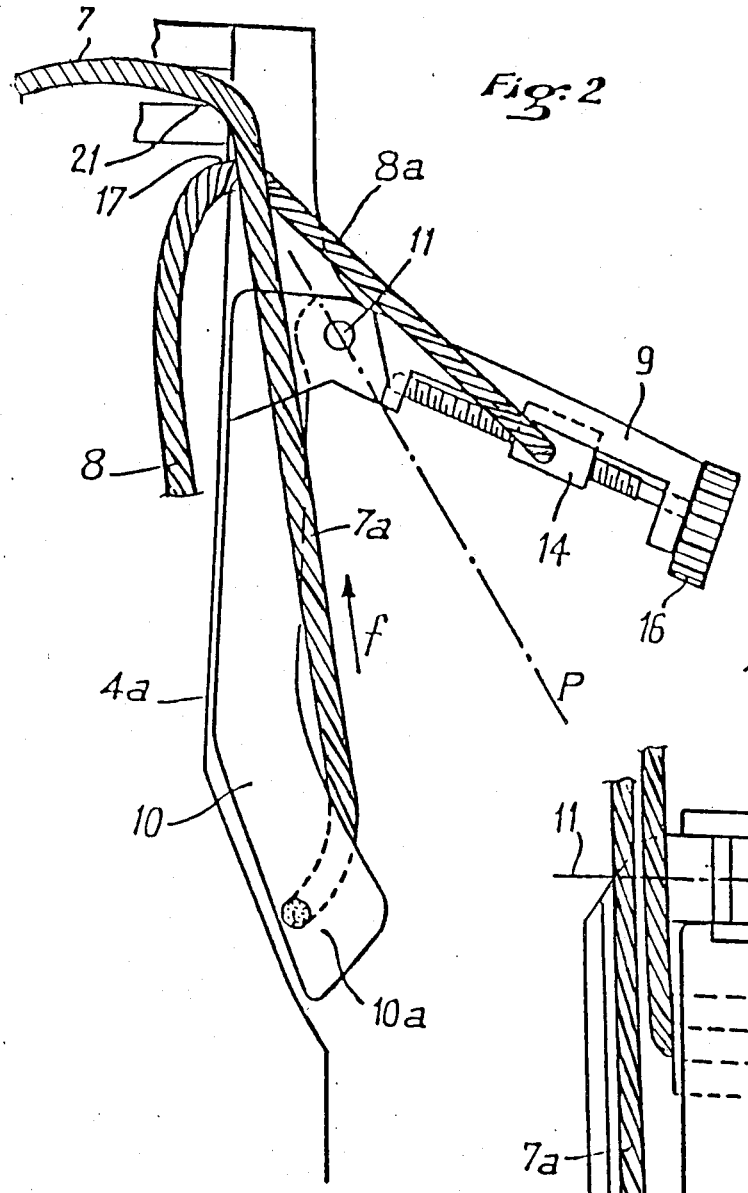
Fig. 2
Fig. 3
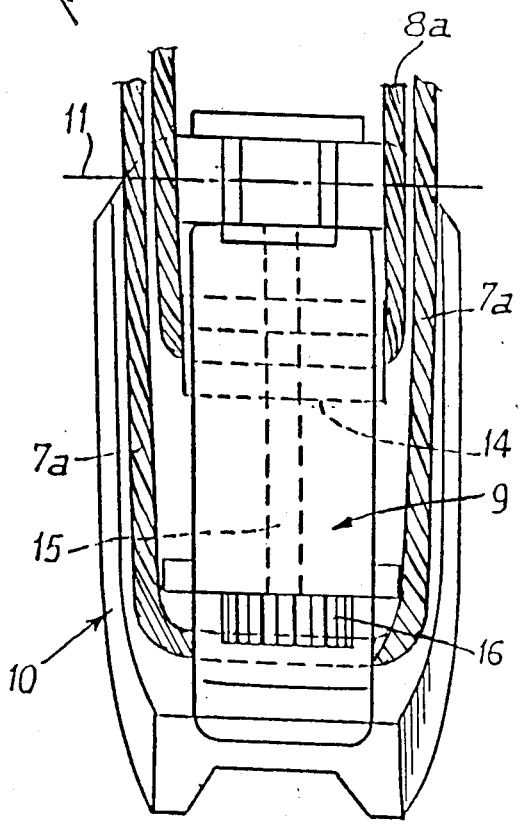

REAR ENTRY SKI BOOT

CROSS-REFERENCE TO RELATED APPLICATIONS

The present application is a continuation-in-part of U.S. Ser. No. 700,302 filed Feb. 11, 1985 which is hereby incorporated by reference. In addition the following pending U.S. applications are related to the present invention: U.S. Pat. No. 4,593,483; U.S. Pat. No. 4,596,080; U.S. Ser. No. 732,636 filed May 10, 1985; U.S. Ser. No. 736,088 filed May 20, 1985; U.S. Ser. No. 748,458 filed June 25, 1985; and U.S. Ser. No. 778,204 filed Oct. 20, 1985.

TECHNICAL FIELD

The present invention relates to a ski boot of the rear entry type.

BACKGROUND ART

Rear entry ski boots comprise an upper mounted on a shell base. The upper comprises an anterior and a posterior portion surrounding the lower leg of the skier. The posterior portion of the upper is journalled on the shell base around a lower transverse axis so that the posterior portion of the upper is adapted to pivot toward the rear, thus creating a sufficiently large opening in the upper to allow the skier to place his foot into the boot, from the rear thereof. These ski boots are provided with a flexible element, such as a cable, to tighten one of the two portions of the upper against the other in a manner so as to obtain a firm tightening of the upper around the lower leg of the skier. Another flexible tightening element is positioned inside the boot and extends above the instep of the foot of the skier. When this element is tensioned or stretched it presses the foot towards the bottom and towards the rear of the boot. This latter flexible element thus assures the tightening of the foot in the zone known as the "short perimeter of the heel".

In the rear entry ski boot described in European Pat. No. 0053 340, the two flexible tightening elements for tightening the upper on the lower leg and for internally holding down the foot in the boot are connected to a manipulation element mounted on the exterior of the boot, at the rear of the posterior portion of the upper. Once the foot is engaged in the boot, manipulation of the manipulation element exerts a traction simultaneously on the two tightening elements. One thus obtains simultaneously, by action on a single pivotable lever, the tightening of the upper on the lower leg of the skier and an internal tightening of the foot in the boot in the zone of the short perimeter of the heel. As a result, this ski boot can be used either only totally closed or totally loose. However has become clear that it is desirable, in order to increase the comfort of skiers, to tighten the upper on the lower leg of the skier while the foot in not held down in the boot, and to hold down the foot in the boot while the upper is not tightening around the lower leg of the skier. This ski boot cannot perform these functions because the tightening of the upper on the lower leg of the skier causes the foot to be held down in the boot and vice a versa.

Thus, there is a need for a ski boot in which the upper can be tightened around the lower leg of the skier independently of the tightening of the foot in the boot.

DISCLOSURE OF THE INVENTION

It is an object of the present invention to provide a ski boot and an apparatus to be used with a ski boot that tightens the upper around the lower leg of the skier independently of the mechanism for holding down the foot in the boot.

It is another object of the present invention to provide a ski boot and an apparatus to be used with a ski boot that holds down the foot in the boot independently of the tightening of the upper on the lower leg of the skier.

The invention which achieves these objectives comprises a ski boot for holding the foot and the lower leg of a skier therein. The ski boot comprises means for tightening the boot on the lower leg of the skier means for holding the foot of the skier down in the boot, first means for actuating the tightening means to tighten the boot on the lower leg of the skier, and second means for actuating the holding means to hold down the foot of the skier in the boot. The first and second actuating means comprise separate levers.

The tightening means and the holding means comprise, respectively, first and second flexible elements and the first and second actuating means comprise, respectively, means for exerting a traction force on the first and second flexible elements.

The boot further comprises a shell base, and an upper surrounding the lower leg of the skier. The upper, in turn, comprises at least one anterior portion and at least one posterior portion. The posterior portion is journalled around an axis substantially transverse to the longitudinal axis of the boot. The transverse axis passes through a portion of the boot substantially corresponding to the malleoli of the skier. In this embodiment the tightening means comprises means for tightening the at least one anterior and posterior portions of the boot against the lower leg of the skier. The at least one posterior portion of the boot comprises a rear portion, and the first and second actuting means comprise, respectively, first and second manipulation levers journalled on the exterior of the boot on the rear portion of the at least one posterior portion of the upper.

The tightening means comprises means for tightening the at least one posterior and anterior portions of the boot with respect to each other. The tightening means further comprises a first flexible element and the holding means further comprises a second flexible element. In addition, in this embodiment the first lever comprise means for exerting a traction force on the first flexible element and the second lever comprises means for exerting a traction force on the second flexible element. The second flexible element comprises means for pressing the foot downwardly and rearwardly so as to press the heel of the foot downwardly and rearwardly in the boot and so as to hold down the foot of the skier in the boot in the zone of the short perimeter of the heel of the foot. In addition, the second flexible element extends within the boot and over the instep of the foot of the skier to press the foot of the skier downwardly and rearwardly in response to a traction force exerted by the second lever.

In one embodiment the first and second actuating means comprise two independent manipulation levers, one of which is positioned above the other, and both of which are journalled on the at least one posterior portion of the upper around an axis transverse to the longitudinal axis of the boot. The first flexible element is connected to the first manipulation lever and the second flexible element is connected to the second manipulation lever.

In one embodiment the first and second levers are journalled around the same transverse axis, and in an alternative embodiment the first and second levers are journalled around different transverse axes such that one of the transverse axes is positioned above the other of the transverse axes.

In addition, the first lever may be positioned below the second lever so that the first lever comprises a lower lever and the second lever comprises an upper lever. Alternatively, the first lever can be positioned above the second lever so that the first lever comprises an upper lever and the second lever comprises a lower lever.

In still another embodiment the first and second manipulation levers are journalled around an axis transverse to the longitudinal axis of the boot and the at least one posterior portion of the upper further comprises first and second openings. In this embodiment the first flexible element extends through the first opening in such a manner that the direction of the first flexible element changes as the flexible element extends through the first opening, whereby the portion of the posterior portion of the boot surrounding the first opening comprises a first direction changing element, and the second flexible element extends through the second opening in such a manner that the direction of the second flexible element changes as the second flexible element extends through the second opening, whereby the portion of the posterior portion of the boot surrounding the second opening comprises a second direction changing element. In addition, the first and second direction changing elements are positioned above the transverse axes of the first and second levers.

In addition, in this embodiment at least one of the first and second levers, the transverse axis around which one of the first and second levers is journalled, and at least one of the first and second direction changing elements together comprise a toggle mechanism comprising means for producing first and second stable positions for at least one of the first and second levers on either side of a plane passing through the transverse axis around which at least one of the first and second levers is journalled and passing substantially through one of the first and second openings.

In another embodiment the second lever comprises means for adjusting the tension on the second flexible element. In this embodiment the adjusting means comprises a threaded shaft extending in longitudinally along the second lever. The shaft comprising an exterior end at the opposite end of the second lever from the transverse axis around which the second lever is journalled. Also provided is a screw and a tension adjustment button. The screw engages the threaded shaft and is adapted to be displaced along the shaft in response to rotation of the shaft. In addition, the second flexible element is attached to the screw. The tension adjustment button is positioned at the exterior end of the threaded shaft.

In still another embodiment the first and second actuating means are each adapted to be positioned in an open position and a locked position. In the locked position the first and second actuating means actuate the tightening and holding means, respectively. In the open position the force on the lower leg of the skier from the tightening means and the force on the foot from the holding means in substantially reduced. In addition the boot can further comprise toggle means for producing stable open and closed positions for the first and second actuating means.

In still another embodiment, the invention relates to an apparatus for actuating a hold down means in a ski boot to hold down the foot of a skier in the boot and for actuating a tigtening means in a ski boot to tighten the boot on the lower leg of the skier. The apparatus comprises first actuating means for actuating the hold down mechanism to hold down the foot of a skier in the boot, and second actuating means for actuating the tightening mechanism to tighten the boot on the lower leg of the skier. The first and second actuating means are separate levers. In addition, in this embodiment the invention includes all the other features noted in the embodiments described above.

BRIEF DESCRIPTION OF THE DRAWINGS

The invention will be better understood by reference to the detailed description that follows, which describes, by way of non-limiting example, various embodiments of the present invention with reference to the attached drawings in which:

FIG. 2 is a longitudinal and vertical cross sectional view, on a larger scale than FIG. 1, of a rear portion of the posterior portion of the upper of the ski boot illustrated in FIG. 1, the upper manipulation lever being shown in its unlocked position, while the lower manipulation lever is shown in its locked position;

FIG. 3 is a rear view of the boot illustrated in FIG. 1, the two manipulation levers being shown lowered into their locked position;

DETAILED DESCRIPTION

Figures 1, 6:
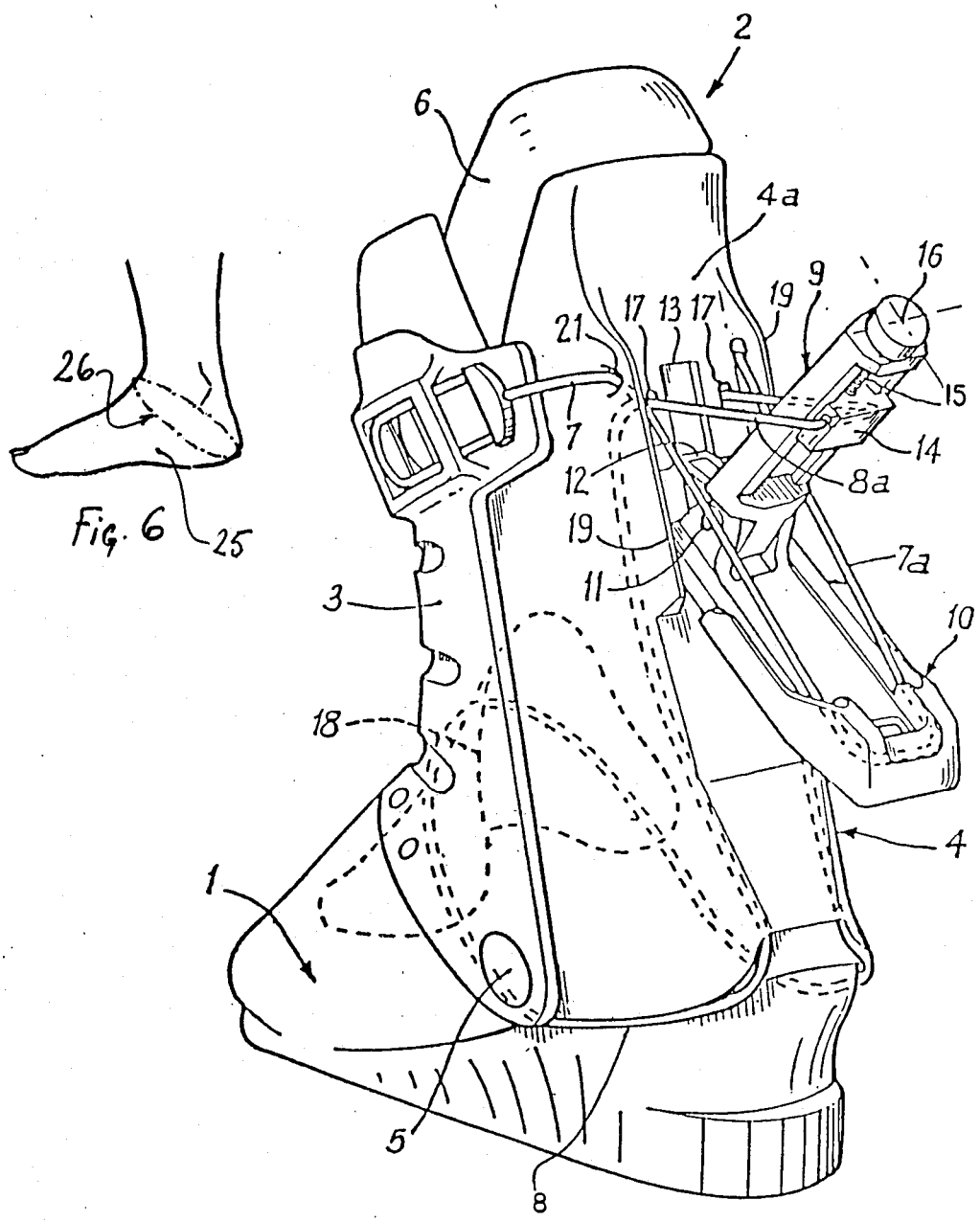
FIG. 1 is a perspective view of a rear entry ski boot whose two manipulation levers are journalled around a common transverse axis, the two levers being shown in the unlocked or open position.
FIG. 6 is a schematic view of the short perimeter of the heel.

The present invention relates to an improvement in a rear entry ski boot of the type previously discussed so as to improve its conditions of use by allowing the tensioning of one or the other of the two flexible tightening elements depending upon the result that is desired.

To this end the rear entry ski boot of the present invention comprises an upper mounted on a shell base. The upper comprises an anterior and a posterior portion surrounding the lower leg of the skier. The posterior portion of the upper is journalled on the shell base around a lower transverse axis. Also provided is a first flexible tightening element for tightening the upper on the lower leg of the skier by tightening one portion of the upper against the other. In addition, the boot further comprises a second flexible tightening element positioned inside the boot for the exerting a force on the foot in the zone of the short perimeter of the heel to hold the foot down in the boot. This tightening element is positioned within the boot and extends above the instep of the skier's foot to press the foot downwardly and rearwardly when tensioned. In addition, the boot further comprises means, mounted on the exterior of the boot, at the rear of the posterior portion of the upper, to exert a traction force on the two flexible tightening elements. This means comprises two indepenent manipulation levers positioned one above the other on the posterior portion of the upper. Each lever is journalled around at least one transverse axis. Each of the two flexible tightening elements are connected to a different lever.

The two manipulation levers can be journalled around a the same single transverse axis or they can be journalled respectively around two separate axes positioned above one another.

By virtue of this arrangement it is possible, according to the invention, to unlock only the upper pivoting lever and to consequently release only the tightening element which is connected to this upper lever; the lower lever remains locked in its locked, tightened position in which it exerts a traction force on the flexible element to which it is attached.

The upper and lower pivotable levers can be connected, respectively, to flexible elements internally tightening the foot in the zone of the short perimeter of the heel and tightening the upper on the lower leg of the skier. In this embodiment, the unlocking of the single upper manipulation lever serves to release only the mechanism governing the internal tightening of the foot in the boot so that a force is no longer exerted on the foot to hold the foot down in the boot. This arrangement is particularly advantageous because it allows the skier not to tighten his foot before actually skiing seriously, which assures proper circulation of the blood and provides a feeling of comfort, while at the same time firmly holding the boot on the lower leg of the skier by virtue of the traction exerted on the tightening element for tightening the upper around the lower leg of the skier.

According to an alternative embodiment, the upper and lower manipulation levers are connected, respectively, to flexible elements tightening the upper around the lower leg of the skier and internally tightening the foot in the zone of the short perimeter of the heel so as to press the foot downwardly and rearwardly in the boot. In this embodiment the upper manipulation lever only loosens the mechanism for tightening the upper around the lower leg of the skier, thereby loosening the upper around the lower leg of the skier. The skier can then walk with his boot whose upper is open, because the foot is maintained tightly in the interior of the boot by virtue of the internal tightening element which is always tensioned or stretched so as to firmly press the foot downwardly and rearwardly in the boot.

The ski boot shown in FIGS. 1–3 is of the rear entry type and it comprises, in a conventional manner, a shell base 1 and an upper 2. Upper 2 comprises two portions: an anterior portion 3 and a posterior portion 4. Posterior portion 4 of upper 2 is journalled on shell base 1, around a horizontal and lower transverse axis 5. Ski boot 1 also comprises an intermediate slipper 6 in which the foot of the skier is inserted so as to assure a certain degree of comfort.

The ski boot shown in FIG. 1 also comprises two flexible tightening elements, such as cables. These flexible tightening elements comprise a cable 7 for tightening the upper on the lower leg of the skier, and a cable 8 for internally holding down the foot in the boot in the zone of the short perimeter of the heel of the foot 26 (illustrated in FIG. 6) by pressing the foot downwardly and rearwardly at the instep of the foot.

According to the invention tightening cables 7 and 8 are tensioned, respectively, by displacing two pivotable manipulation levers 9 and 10 from an open or unlocked position to a locked position. In the non-limiting embodiment illustrated in FIGS. 1–3 cables 7 and 8 are journalled around a common horizontal and transverse journal 11 which extends transverse to the longitudinal axis of the boot. Journal 11 is supported by a bearing 12 attached to the upper zone of a rear surface **4*a* of posterior portion 4 of the upper. If desired, means can be provided for adjusting the vertical position of bearing 12 by permitting bearing 12 to vertically slide in a vertical slot 13 in rear surface 4*a***.

In the embodiment illustrated in FIG. 1 upper lever 9 is connected to cable 8 while lower lever 10 is connected to cable 7. However, this arrangement can well be reversed, as will be seen below.

Cable 8 for internally holding down the foot in the boot is attached to a screw 14 which is slideably mounted along upper lever 9. Screw 14 engages a threaded shaft 15 extending longitudinally on lever 9. The external end of shaft 15 comprises a tension adjustment button 16. Rotation of button 16 causes a linear displacement of screw 14, thereby changing the position of screw 14 and consequently changing the tension of internal tightening cable 8.

Starting at bolt 14, cable 8 forms a loop **8*a* which extends through two openings or holes 17 provided in the upper zone of surface 4*a* on both sides of slot 13. These holes 17 and/or that portion of posterior portion 4 immediately surrounding holes 17 comprise direction changing elements because the direction of cable 8 changes when cable 8 extends through openings 17. Holes 17 are positioned above journal 11. From holes 17 cable 8 then extends, on each lateral side of the boot, downwardly to the interior of posterior portion 4. From this point cable 8 extends toward the front and upwardly to extend over the instep of the foot. At the instep cable 8 may contact a pressure plate 18 for distributing the pressure from cable 8 to the foot. The pressure plate is optional. When the pressure plate is not used cable 8** presses directly on the top of the foot at or near the instep.

Cable 7 also forms a loop **7*a* attached to the lower end of lower pivotable lever 10. The two strands of loop 7*a* extend upwardly between two substantially parallel lateral and substantially vertical edges 19 which form an integral portion of rear surface 4*a* and extend substantially the length of the zone comprising slot 13 and bearing 12. The two strands of loop 7*a* of cable 7 are then deflected toward the exterior, substantially horizontally, by passing through holes 21 provided in vertical edges 19 of the boot. Holes 21 and/or the material of the boot immediately surrounding holes 21 comprise direction changing elements because cable 7 changes its direction as it extends though holes 21. Holes 21 are positioned above the journal 11, substantially or almost at the same vertical level as holes 17. The ends of the two cable ends of cable 7 are integrally attached to attachment or hooking elements, whose position is adjustable at the upper zone of anterior portion 3 of upper 2**.

Levers 9 and 10 are displaced into their locked position, in which levers 9 and 10 exert a traction force on cables 7 and 8, by pressing levers 9 and 10 downwardly against the lower zone of rear surface 4*a* so that lower lever 10 rests against rear surface 4*a* as is shown in Fig. 2, and upper lever 9 is pressed against lower lever 10. In order to achieve this result, lower lever 10 is preferably configured so as to comprise a central hollow portion in which upper lever 9 can be retractably positioned in its locked or total tightening position. In their locked position levers 9 and 10 exert a traction force on cables 7 and 8.

This traction force exerted by levers 9 and 10 on cables 7 and 8 is adjustable. The traction on internal holddown cable 8 is adjustable by means of button 16 which, as noted above, controls the displacement of screw 14. The traction exerted on cable 7 for tightening the upper around the lower leg of the skier is adjustable by changing the position of the hooking or attaching element to which the end of cable 7 is attached on anterior portion 3 of the upper.

Pivotable levers 9 and 10 are journalled around a common journal or axis 11 in a manner so as to comprise a type of toggle or elbow joint mechanism. This toggle mechanism is formed by upper holes 17 and 21 (which comprise direction changing elements for cables 7 and 8) and transverse journal 11 common to levers 9 and 10. As a result, in its locked position, as illustrated in FIG. 2 for lower lever 10, lower end 10*a* of lever 10 (to which cable 7 is connected) is positioned beneath a plane P passing through holes 21 and journal 11. Consequently, the return force exerted by cable 7, as a result of its tension on the lower end of lever 10 (illustrated by arrow f in FIG. 2) tends to maintain lever 10 pressed against rear surface 4*a*, i.e., lever 10 is maintained firmly in its locked position. Similarly, the return force of cable 8, as a result of its tension on the lower end of lever 9 tends to maintain lever 9 pressed against lever 10 because in its locked position screw 14, to which cable 8 is attached, is positioned beneath plane P which passes substantially through hole 17 and common journal or axis 11.

Because holes 17 and 21, which form direction changing elements for cables 7 and 8, are positioned sufficiently far above common journal or axis 11 of levers 9 and 10, downward pivoting of levers 9 and 10 from their open position results in an increase in the distance between holes 17 and 21 and the moveable ends of levers 9 and 10. This distance is a maximum when the two levers are in plane P. Similarly, downward pivoting of levers 9 and 10 results in an increase in the traction force exerted on cable 7 and 8 by levers 9 and 10. This traction force is a maximum when the two levers are in plane P.

To entirely loosen the boot with respect to the foot it suffices to pivot levers 9 and 10 in the counterclockwise direction when viewed in FIGS. 1 and 2 around common journal 11. Once levers 9 and 10 pass the equilibrium position defined by plane P, cables 7 and 8 can loosen and cause upward pivoting levers 9 and 10. The total tightening of the boot, i.e., both the tightening of the upper around the lower leg of the skier as well as the internal holding down of the foot in the boot can be achieved by manually pivoting levers 9 and 10 downwardly from their open position above plane P to their locked position below plane P in which levers 9 and 10 are pressed against the lower zone of rear surface 4*a*.

As a result of this structure, the ski boot of the present invention has the advantage of permitting simultaneous tightening of the upper around the lower leg of the skier and internally holding down the foot in the boot, while also permitting the lower leg of the skier to be held loosely when the foot is held down firmly in the boot. This is illustrated in FIG. 2, which shows lower lever 10 in its locked position pressed against the lower zone of rear surface 4*a*, while lever 9 has pivoted upwardly in the counterclockwise direction into its open unlocked position above plane P to loosen the holding down of the foot in the boot. This is a distinct advantage for racers because they can maintain their feet loosely, before the beginning of a race, to assure proper circulation of the blood and proper comfort, while maintaining the upper tightly around their lower leg.

Figure 4:
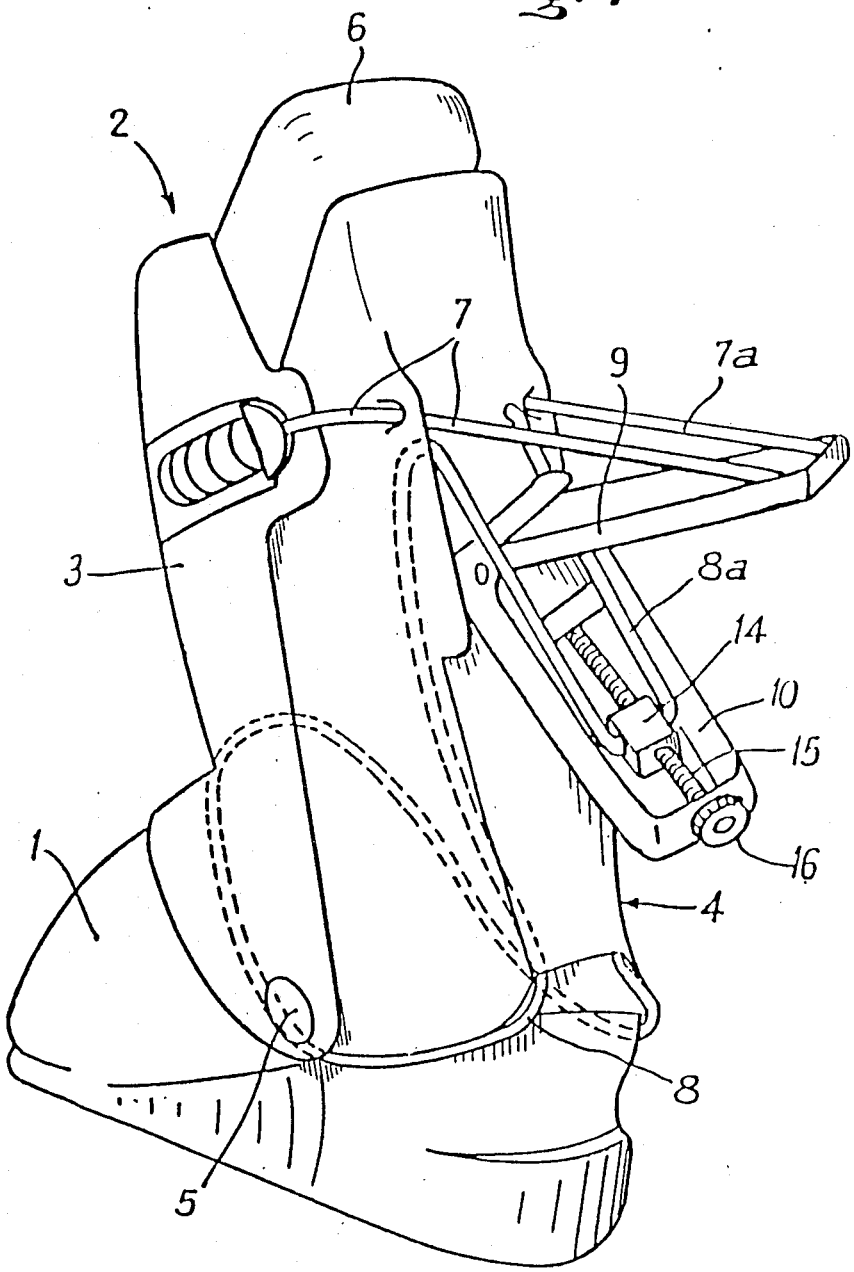
FIG. 4 is a perspective view of one alternative embodiment in which the upper and lower manipulation levers, journalled around the same single transverse axis, are respectively connected to cables for tightening the upper on the lower leg of the skier and for internally holding down the foot in the boot.

FIG. 4 illustrates an alternative embodiment in which upper lever 9 is connected to cable 7, which tightens the upper around the lower leg of the skier, while lower lever 10 is connected to cable 8 which exerts a force to press the foot downwardly and rearwardly in the boot. This embodiment permits only cable 8 to be tightened, while cable 7 is loose. This can be accomplished by pressing lower lever 10 into its locked position against rear surface 4*a*, while the upper lever 9 is displaced into its free, unlocked open position to give slack to cable 7. In this position upper 2 is open, which permits the skier to walk without difficulty because the boot is always held on the foot because of tightened cable 8.

Figure 5:
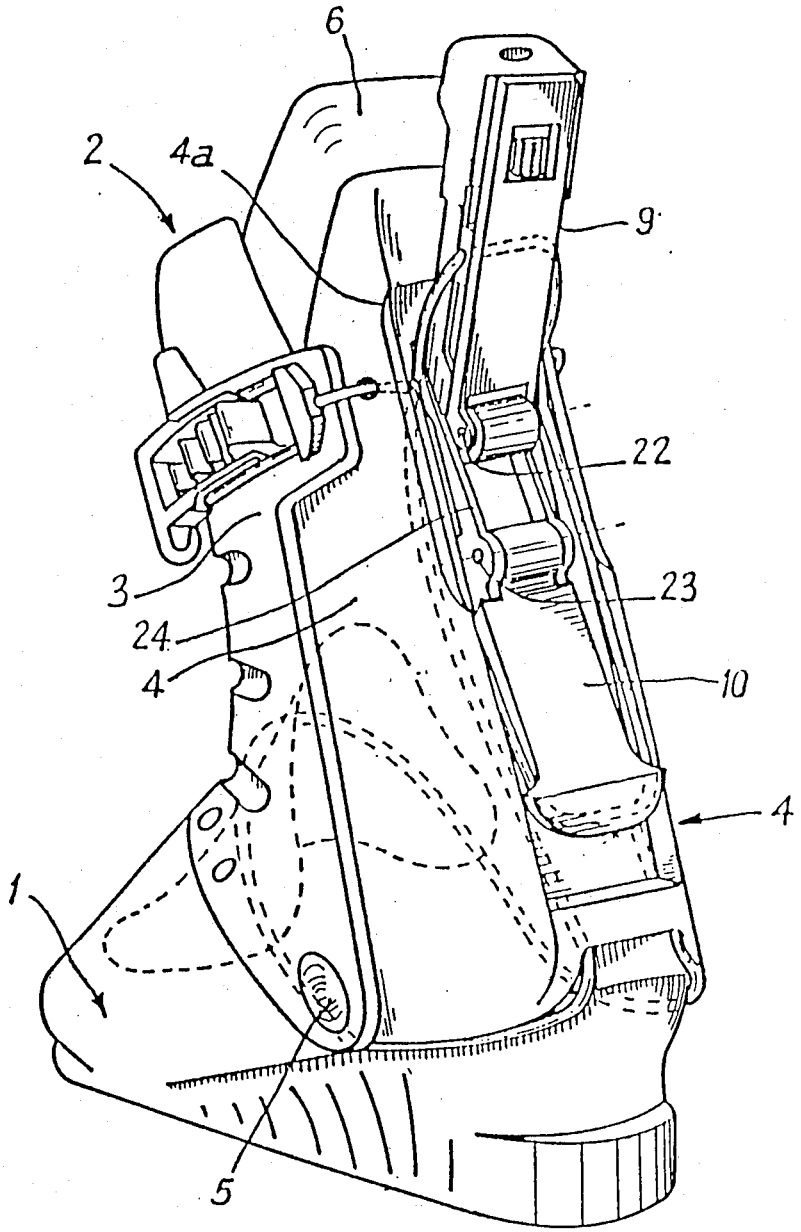
FIG. 5 is a perspective view of another alternative embodiment in which the upper and lower manipulation levers are journalled, respectively, around two distinct transverse axes.

FIG. 5 illustrates an alternative embodiment in which upper lever 9 and lower lever 10 are respectively journalled around spaced apart distinct horizontal and transverse axes 22, 23 positioned one above the other and mounted on a support 24 attached to rear surface 4*a* of posterior portion 4 of upper 2. In FIG. 5 lower lever 10 is shown in the locked position, in which it is maintained against rear surface 4*a*. In this position it exerts a traction force on cable 7 which causes the upper to be tightened around the lower leg of the skier. As also illustrated in FIG. 5, upper lever 9 is in its unlocked position in which it is in an upwardly inclined position. In this position cable 8 is released from being tensioned and the foot of the skier is not held tightly within the boot.

Although the invention has been described with respect to particular means, methods, and embodiments, it should be understood that the invention is not limited thereto but extends to all equivalents within the scope of the claims.

We claim:

1. A ski boot for holding the lower leg and the foot of the skier therein, wherein said ski boot comprises:

(a) means for tightening said boot on the lower leg of the skier;

(b) means for holding the foot of the skier down in said boot;

(c) first means for actuating said tightening means to tighten said boot on the lower leg of the skier; and (d) second means for actuating said holding means to hold down the foot of the skier in said boot, wherein said first and second actuating means comprise separate levers, wherein said boot further comprises a shell base, and an upper surrounding the lower leg of the skier comprising at least one posterior portion, wherein said first and second actuating means comprise two independent manipulation levers, one of which is positioned above the other, and both of which are journalled on said at least one posterior portion of said upper around an axis transverse to the longitudinal axis of said boot, wherein said tightening means is connected to one of said manipulation levers, wherein said holding means is connected to the other of said manipulation levers.

2. The boot defined by claim 1 wherein said tightening means and said holding means comprise, respectively, first and second flexible elements, wherein said first and second actuating means comprise, respectively, means for exerting a traction force on said first and second flexible elements.

3. The boot defined by claim 1 wherein the foot of the skier comprises malleoli, wherein said boot further comprises:

a shell base; and an upper surrounding the lower leg of said skier comprising:

at least one anterior portion; and at least one posterior portion, wherein said posterior portion is journalled around an axis substantially transverse to the longitudinal axis of said boot, wherein said transverse axis passes through a portion of said boot substantially corresponding to said malleoli of said skier, wherein said tightening means comprises means for tightening said at least one anterior and posterior portions of said boot against the lower leg of the skier.

4. The boot defined by claim 3 wherein said at least one posterior portion of said boot comprises a rear portion, wherein said first and second actuating means comprise, respectively, first and second manipulation levers journalled on the exterior of said boot on said rear portion of said at least one posterior portion of said upper.

5. The boot defined by claim 4 wherein said tightening means comprises means for tightening said at least one posterior and anterior portions of said boot with respect to each other.

6. The boot defined by claim 5 wherein said tightening means comprises a first flexible element, wherein said holding means comprises a second flexible element, wherein said first lever comprise means for exerting a traction force on said first flexible element, wherein said second lever comprises means for exerting a traction force on said second flexible element.

7. The boot defined by claim 6 wherein the foot of said skier comprises a heel, wherein said second flexible element comprises means for pressing said foot downwardly and rearwardly so as to press said heel downwardly and rearwardly in said boot and so as to hold down the foot of the skier in said boot in the zone of the short perimeter of the heel of the foot.

8. The boot defined by claim 7 wherein the foot of the skier comprises an instep, wherein said second flexible element extends within said boot and over said instep of the foot of the skier to press the foot of the skier downwardly and rearwardly in response to a traction force exerted by said second lever.

9. The boot defined by claim 8 wherein said first and second levers are journalled around the same transverse axis.

10. The boot defined by claim 8 wherein said first and second levers are journalled around different transverse axes, wherein one of said transverse axes is positioned above the other of said transverse axes.

11. The boot defined by claim 8 wherein said first lever is positioned below said second lever so that said first lever comprises a lower lever and said second lever comprises an upper lever.

12. The boot defined by claim 8 wherein said first lever is positioned above said second lever so that said first lever comprises an upper lever and said second lever comprises a lower lever.

13. The boot defined by claim 8 wherein said first and second manipulation levers are journalled aorund an axis transverse to the longitudinal axis of said boot, wherein said at least one posterior portion of said upper further comprises first and second openings, wherein said first flexible element extends through said first opening in such a manner that the direction of said first flexible element changes as said first flexible element extends through said first opening, whereby the portion of said posterior portion of said boot surrounding said first opening comprises a first direction changing element, wherein said second flexible element extends through said second opening in such a manner that the direction of said second flexible element changes as said second flexible element extends through said second opening, whereby the portion of said posterior portion of said boot surrounding said second opening comprises a second direction changing element, wherein said first and second direction changing elements are positioned above said transverse axes of said first and second levers.

14. The boot defined by claim 13 wherein at least one of said first and second levers, said transverse axis around which one of said first and second levers is journalled, and at least one of said first and second direction changing elements together comprise a toggle mechanism comprising means for producing first and second stable positions for at least one of said first and second levers on either side of a plane passing through said transverse axis around which at least one of said first and second levers is journalled and passing substantially through one of said first and second openings.

15. The boot defined by claim 8 wherein said second lever comprises means for adjusting the tension on said second flexible element.

16. The boot defined by claim 15 wherein said adjusting means comprises:

a threaded shaft extending in longitudinally along said second lever, said shaft comprising an exterior end at the opposite end of said second lever from said transverse axis around which said second lever is journalled;

a screw engaging said threaded shaft and adapted to be displaced along said shaft in response to rotation of said shaft, wherein said second flexible element is attached to said screw; and a tension adjustment button positioned at said exterior end of said threaded shaft.

17. The boot defined by claim 1 wherein said first and second actuating means are each adapted to be positioned in an open position and a locked position, wherein in said locked position said first and second actuating means actuate said tightening and holding means, respectively, wherein in said open position, the force on the lower leg of the skier from said tightening means and the force on the foot from said holding means in substantially reduced.

18. The boot defined by claim 17 further comprising a toggle means for producing stable open and closed positions for said first and second actuating means.

19. An apparatus for actuating a hold down means in a ski boot to hold down the foot of a skier in the boot and for actuating a tightening means in a ski boot to tighten the boot on the lower leg of the skier, wherein said apparatus comprises:

(a) first actuating means for actuating said hold down means to hold down the foot of a skier in said boot; and (b) second actuating means for actuating said tightening means to tighten said boot on the lower leg of said skier, wherein said first and second actuating means are separate levers, wherein said first and second actuating means comprise two independent manipulation levers, one of which is positioned above the other, both of which are journalled on a posterior portion of the upper of the boot around an axis transverse to the longitudinal axis of said boot, wherein one of said levers is connected to said hold down means, and the other of said levers is connected to said tightening means.

20. The boot defined by claim 19 wherein said first and second actuating means are each adapted to be positioned in an open position and a locked position, wherein in said locked position said first and second actuating means actuate said tightening and holding means, respectively, wherein in said open position, the force on the lower leg of the skier from said tightening means and the force on the foot from said holding means in substantially reduced.

21. The boot defined by claim 20 further comprising a toggle means for producing stable open and closed positions for said first and second actuating means.

22. The boot defined by claim 19 wherein said tightening means and said holding means comprise, respectively, first and second flexible elements, wherein said first and second actuating means comprise, respectively, means for exerting a traction force on said first and second flexible elements.

23. The boot defined by claim 22 wherein the foot of the skier comprises malleoli, wherein said boot further comprises a shell base and an upper surrounding the lower leg of said skier comprising at least one anterior portion; and at least one posterior portion, wherein said posterior portion is journalled around an axis substantially transverse to the longitudinal axis of said boot, wherein said tranverse axis passes through a portion of said boot substantially corresponding to said malleoli of said skier, wherein said tightening means comprises means for tightening said at least one anterior and posterior portions of said boot against the lower leg of the skier, wherein said at least one posterior portion of said boot comprises a rear portion, wherein said first and second actuating means comprise, respectively, first and second manipulation levers journalled on the exterior of said boot on said at rear portion of said at least one posterior portion of said upper, wherein said tightening means comprises means for tightening said at least one posterior and anterior portions of said boot against each other.

24. The boot defined by claim 23 wherein said tightening means comprises a first flexible element, wherein said holding means comprises a second flexible element, wherein said first lever comprise means for exerting a traction force on said first flexible element, wherein said second lever comprises means for exerting a traction force on said second flexible element, wherein the foot of said skier comprises a heel, wherein said second flexible element comprises means for pressing said foot downwardly and rearwardly so as to press said heel downwardly and rearwardly in said boot and so as to hold down the foot of the skier in said boot in the zone of the short perimeter of the heel of the foot.

25. The boot defined by claim 24 wherein the foot of the skier comprises an instep, wherein said second flexible element extends within said boot and over said instep of the foot of the skier to press the foot of the skier downwardly and rearwardly in response to a traction force exerted by said second lever.

26. The boot defined by claim 25 wherein said first and second levers are journalled around the same transverse axis.

27. The boot defined by claim 25 wherein said first and second levers are journalled around different transverse axes, wherein one of said transverse axes is positioned above the other of said transverse axes.

28. The boot defined by claim 25 wherein said first lever is positioned below said second lever so that said first lever comprises a lower lever and said second lever comprises an upper lever.

29. The boot defined by claim 25 wherein said first lever is positioned above said second lever so that said first lever comprises an upper lever and said second lever comprises a lower lever.

30. The boot defined by claim 25 wherein said first and second manipulation levers are journalled around an axis transverse to the longitudinal axis of said boot, wherein said at least one posterior portion of said upper further comprises first and second openings, wherein said first flexible element extends through said first opening in such a manner that the direction of said first flexible element changes as said first flexible element extends through said first opening, whereby the portion of said posterior portion of said boot surrounding said first opening comprises a first direction changing element, wherein said second flexible element extends through said second opening in such a manner that the direction of said second flexible element changes as said second flexible element extends through said second opening, whereby the portion of said posterior portion of said boot surrounding said second opening comprises a second direction changing element, wherein said first and second direction changing elements are positioned above said transverse axes of said first and second levers.

31. The boot defined by claim 30 wherein at least one of said first and second levers, said transverse axis around which one of said first and second levers is journalled, and at least one of said first and second direction changing elements together comprise a toggle mechanism comprising means for producing first and second stable positions for at least one of said first and second levers on either side of a plane passing through said transverse axis around which at least one of said first and second levers is journalled and passing substantially through one of said first and second openings.

32. The boot defined by claim 25 wherein said second lever comprises means for adjusting the tension on said second flexible element, wherein said adjusting means comprises:

a threaded shaft extending in longitudinally along said second lever, said shaft comprising an exterior end at the opposite end of said second lever from said transverse axis around which said second lever is journalled;

an screw engaging said threaded shaft and adapted to be displaced along said shaft in response to rotation of said shaft, wherein said second flexible element is attached to said screw; and a tension adjustment button positioned at said exterior end of said threaded shaft.

* * * * *

UNITED STATES PATENT AND TRADEMARK OFFICE

CERTIFICATE OF CORRECTION

PATENT NO. : 4,677,768

DATED : July 7, 1987

INVENTOR(S) : Louis BENOIT et al.

It is certified that error appears in the above-identified patent and that said Letters Patent is hereby corrected as shown below:

At column 2, line 40, change "actuting" to ---actuating---.

At column 3, line 51, delete "in" before "longitudinally".

At column 4, line 8, change "tigtening" to ---tightening---.

At column 4, line 67, delete "the" before "exerting".

At column 5, line 15, delete "a" after "around".

At column 10, line 3, (claim 13, line 2) change "aorund" to ---around---.

At column 12, line 62, (claim 32, line 10) change "an screw" to ---a screw---.

Signed and Sealed this

Twenty-first Day of August, 1990

*Attest:*

HARRY F. MANBECK, JR.

*Attesting Officer*

*Commissioner of Patents and Trademarks*